United States Patent [19]

Miyajima et al.

[11] 4,259,216

[45] Mar. 31, 1981

[54] PROCESS FOR PRODUCING LIQUID DETERGENT COMPOSITION

[75] Inventors: Nobuyuki Miyajima, Tokyo; Nobuo Johna, Funabashi; Naoki Mizushima, Ichikawa; Kazuo Ohbu, Tokyo, all of Japan

[73] Assignee: The Lion Fat & Oil Co., Ltd., Tokyo, Japan

[21] Appl. No.: 131,637

[22] Filed: Mar. 19, 1980

[30] Foreign Application Priority Data

Oct. 11, 1979 [JP] Japan ..... 54/131199

[51] Int. Cl.[3] ..... C11D 1/14; C11D 1/83; C11D 11/00

[52] U.S. Cl. ..... 252/545; 252/548; 252/551; 252/555; 252/DIG. 14

[58] Field of Search ..... 252/545, 547, 551, 555, 252/DIG. 14

[56] References Cited

U.S. PATENT DOCUMENTS

| | | | |
|---|---|---|---|
| 3,179,599 | 4/1965 | Eaton et al. | 252/153 |
| 3,192,166 | 6/1965 | Smith | 252/528 |
| 3,336,387 | 8/1967 | Finch et al. | 260/583 |
| 3,565,810 | 2/1971 | Mausner et al. | 252/547 |
| 3,808,156 | 4/1974 | Gorisch et al. | 252/545 |
| 3,852,221 | 12/1974 | Bentley | 252/548 |
| 3,893,955 | 7/1975 | Hewitt et al. | 252/551 |
| 3,899,448 | 8/1975 | Messenger et al. | 252/551 |
| 3,943,234 | 3/1976 | Roggenkamp | 424/343 |
| 3,957,671 | 5/1976 | Sagel et al. | 252/142 |
| 4,064,076 | 12/1977 | Klisch et al. | 252/542 |

FOREIGN PATENT DOCUMENTS

| | | | |
|---|---|---|---|
| 1091517 | 11/1967 | United Kingdom | 252/532 |

*Primary Examiner*—P. E. Willis, Jr.
*Attorney, Agent, or Firm*—Armstrong, Nikaido, Marmelstein & Kubovcik

[57] ABSTRACT

A production process of a liquid detergent composition having both good detergency and little hand roughening action is presented. This liquid detergent composition can be produced by mixing an anionic surface active agent and a semi-polar nonionic surface active agent, each in the stage of an aqueous solution, and then, adding a specified arylsulfonic acid to this mixture in such a manner that the produced liquid detergent composition contains 6 to 25% by weight of the anionic surface active agent, 2 to 8% by weight of the semi-polar nonionic surface active agent and 0.2 to 3.0% by weight of the arylsulfonic acid.

2 Claims, No Drawings

PROCESS FOR PRODUCING LIQUID DETERGENT COMPOSITION

This invention relates to a process for producing a liquid detergent composition suitable for use in washing vegetables and dishes. More specifically, it relates to a process for producing a stable liquid detergent composition which has good detergent characteristics or detergency, and which does not cause the formation of precipitates or sediments and phase separation therein even when the liquid detergent composition is stored at a low temperature.

Conventional detergent compositions heretofore used for washing vegetables and dishes usually contain, as a main ingredient, linear alkylbenzene sulfonates, alkyl sulfates, alkylethoxy sulfates and the like. Although these conventional detergent compositions have good detergent characteristics or detergency, they tend to remove the sebum from human skin. Therefore, these conventional detergent compositions have the disadvantage that, when they are used for the hand washing of vegetables and dishes, the skin on the hands becomes rough and unsightly. In order to prevent this problem, it has been proposed that fatty acid type surface active agents, which have a minor degreasing action, be used as a main ingredient of the conventional detergent compositions, instead of the anionic surface active agents; or that oils and proteins be incorporated into the detergent compositions to suppress their degreasing activity. However, the existing prior arts still do not satisfactorily meet the present demand for liquid detergent compositions, for washing vegetables and dishes, having both good detergency and little or no hand roughening action.

Accordingly, an object of this invention is to obviate the afore-mentioned problem of the prior arts and to provide a process for producing a liquid detergent composition having good detergency and little hand roughening action.

Another object of this invention is to provide a process for producing a liquid detergent composition having good stability of the liquid even at low temperature.

Other objects and advantages of this invention will be apparent from the description set forth hereinbelow.

In accordance with this invention, there is provided a process for producing a liquid detergent composition comprising the steps of:

(a) mixing an aqueous solution of at least one anionic surface active agent selected from the group consisting of (i) the water-soluble salts of alpha-olefin sulfonic acids having 12 to 16 carbon atoms and (ii) the water-soluble salts of polyoxyethylene alkylethersulfates having alkyl groups of 9 to 15 atoms and an average of from 4 to 6 oxyethylene units with an aqueous solution of at least one alkylamine oxide having the formula

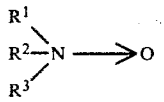

wherein $R^1$ is an alkyl group of 10 to 14 carbon atoms, and $R^2$ and $R^3$ are independently an alkyl or hydroxyalkyl group of 1 to 5 carbon atoms (b) adding, to the mixture, at least one arylsulfonic acid selected from the group consisting of benzene sulfonic acid, toluene sulfonic acid, xylene sulfonic acid and cumene sulfonic acid in an amount of from 0.2 to 3.0% by weight, based on the total weight of the liquid detergent composition, to form a liquid detergent composition containing from 6 to 25% by weight of said anionic surface active agent and from 2 to 8% by weight of said alkyl amine oxide.

The present inventors found, after extensive study of hand roughening caused by the use of detergent compositions, that the denaturation of proteins in skin causes such hand roughening rather than the degreasing of sebum. Based on this finding, the present inventors then conducted studies to develope detergent compositions having good detergency and little hand roughening action. In these studies, the phenomenon of the protein denaturation was used as an indicator of the hand roughening. As a result, the inventors found that protein denaturation can be obviated when alpha-olefin sulfonates (AOS) and/or polyoxyethylene alkylether sulfates (AES) are used in combination with alkylamine oxides and when the pH of the liquid detergent composition is adjusted to approximately 7.5 during its use in the washing of vegetables and dishes. However, since AOS and/or AES, which are anionic surface active agents, form complexes in liquid detergent compositions with alkyl amine oxides, which are semi-polar nonionic surface active agents, there are disadvantages in the liquid detergent compositions in that the stability of the liquid at a low temperature is decreased. The commercial value of neutral liquid detergents is greatly decreased by such a decrease in the stability of the liquid.

Therefore, the present inventors conducted further studies to develope a process for producing a liquid detergent composition in which both said anionic surface active agents and semi-polar nonionic surface active agents are contained, but the above mentioned decrease in the stability of the liquid do not occur. As a result, we have found that the above mentioned decrease in the stability of the liquid at a low temperature can be obviated by: (a) mixing an aqueous solution of said anionic surface active agent with an aqueous solution of said semi-polar nonionic surface active agent, and; (b) adding a specified arylsulfonic acid to the mixture which not affect the prevention of the hand roughening.

In the process according to the present invention, the water-soluble salts of, alpha-olefin sulfonic acids and/or the water-soluble salts of polyoxyethylene alkylethersulfates are employed as anionic surface active agents. Among these agents, the water-soluble salts of the alpha-olefin sulfonic acids are prepared, in any conventional manner, from alpha-olefin or olefins having 12 to 16 carbon atoms. For instance, after sulfonating the alpha-olefin starting material by a thin-film type sulfonation method, the sulfonated products are neutralized with an appropriate basic substance, for example, alkali metal hydroxides, such as sodium hydroxide, potassium hydroxide and the like, alkaline earth metal hydroxides, such as magnesium hydroxide and the like, aqueous ammonia and alkanol amines, such as monoethanol amine, triethanol amine, and; then, the neutralized products are hydrolyzed at a temperature of from 100° to 200° C. to form the water-soluble salts of the alpha-olefin sulfonic acids having 12 to 16 carbon atoms. As the starting material, there may advantageously be employed alpha-olefins, including vinylidene type olefins, which can be prepared by, for example, a wax cracking process, an ethylene polymerization process using a Ziegler-Natta catalyst or modification processes thereof.

The water-soluble salts of the polyoxyethylene alkylethersulfuric acids employed in the present invention include those having the following formula.

$$RO—(CH_2CH_2O)_nSO_3M$$

wherein R is an alkyl group having 9 to 15 carbon atoms, n is the average number within the range of from 4 to 6 and M is an alkali metal, alkaline earth metal, ammonium group or alkanol amide group.

The polyoxyethylene alkylethersulfuric acids can be prepared in any conventional manner. For instance, 4 to 6 moles, on average, based on 1 mol of the starting alcohol, of ethylene oxide are reacted to the starting alcohol in the presence of alkaline catalysts, such as sodium hydroxide and potassium hydroxide, and acid catalysts, such as tin tetrachloride. The polyoxyethylene alkyl ethers thus obtained are sulfated by, for example, a thin-film type sulfation process or chlorosulfonic acid, and the sulfated products are then neutralized with an appropriate basic substance, for example, alkali metal hydroxides, such as sodium hydroxide, potassium hydroxide and the like, alkaline earth metal hydroxides, such as magnesium hydroxide and the like, aqueous ammonia and alkanol amines, such as monoethanol amine, triethanol amine and the like. As the starting alcohols, there may be advantageously used alcohols derived from natural fats and oils, such as coconut oil and the like, synthetic alcohols having branched chains derived from oxo synthesis of olefins and synthetic straight-chain or linear alcohols derived from ethylene by a Ziegler process. However, among these alcohols, the inventors prefer to use alcohols derived from the oxo synthesis having 45 to 90% of linearity (i.e. rate of the straight chain) and including branched chains.

The semi-polar nonionic surface active agents employed, in combination with said anionic surface active agents, in the present invention are alkylamine oxides having the following formula.

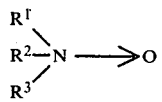

wherein $R^1$ is an alkyl group of 10 to 14 carbon atoms, and $R^2$ and $R^3$ are independently an alkyl or hydroxyalkyl group of 1 to 5 carbon atoms.

Typical examples of such alkylamine oxides are dimethyldecylamine oxide, dimethyltetradecylamine oxide, bis(2-hydroxyethyl)dodecylamine oxide, dimethyldodecylamine oxide, and the like.

According to this invention, said anionic surface active agent and said semi-polar nonionic surface active agent, each in the form of an aqueous solution, are mixed with each other, and at least one arylsulfonic acid selected from the group consisting of benzene sulfonic acid, toluene sulfonic acid, xylene sulfonic acid and cumene sulfonic acid should be added to the mixed solution in an amount of from 0.2 to 3.0% by weight based on the total weight of the liquid detergent composition. The arylsulfonic acid cannot be replaced with other acids, such as inorganic acids, such as sulfuric acid and the like, and organic acids, such as citric acid, succinic acid, tartaric acid, benzoic acid and the like. When the addition amount of the aryl sulfonic acid is less than 0.2% by weight based on the total amount of the liquid detergent composition, the pH of the liquid detergent becomes higher and the protein denaturation is caused. Contrary to this, when the addition amount of the aryl sulfonic acid is more than 3.0% by weight, the stability of the liquid detergent at low temperature becomes insufficient. The mixing of the anionic and the semi-polar nonionic surface active agents, both in the form of aqueous solutions, can be carried out in any conventional manner. However, it should be noted that the contents of the active agents in the solutions and the amounts of the solutions to be mixed should be selected in such amounts that the produced liquid detergent composition contains from 6 to 25% by weight of said anionic surface active agent and from 2 to 8% by weight of said alkyl amine oxide. When the content of the anionic surface active agent in the liquid detergent composition is less than 6% by weight, the detergency becomes insufficient. When the content of the anionic surface active agent is more than 25% by weight, the viscosity of the liquid becomes higher and a large amount of hydrotrope is needed to reduce the viscosity. On the other hand, when the content of the semi-polar nonionic surface active agent in the liquid detergent composition is less than 2% by weight, the detergency becomes insufficient. When the content of the semi-polar nonionic surface active agent is more than 8% by weight, the stability of the liquid at low temperature becomes insufficient.

There is no critical concentration of the active agent in the aqueous solution, so long as the active agent is dissolved in the aqueous solution. However, desirable liquid detergent composition contains from 10 to 25% by weight of said anionic surface active agent and from 2 to 6% by weight of said alkylamine oxide.

So long as the above-mentioned requirements are satisfied, other conventional additives, such as nonionic surface active agents, amphoteric surface active agents, hydrotropes and the like, can be incorporated into the liquid detergent composition according to this invention. Typical examples of such nonionic surface active agents are coconut fatty acid monoethanol amides, coconut fatty acid diethanol amides, alcohol ethoxylates derived from an addition reaction of from 5 to 20 mol, on average, of ethylene oxide to 1 mole of alcohols having 8 to 16 carbon atoms; alkylphenol ethoxylates derived from an addition reaction of from 5 to 10 mol, on average, of ethylene oxide to 1 mol of alkyl phenol having alkyl groups of 8 to 11 carbon atoms and the like. Examples of amphoteric surface active agents optionally employed in this invention are betaine, sulfobetaine, imidazoline and the like. As the hydrotropes, polyethylene glycol, polypropylene glycol, ethylene glycol, glycerine, sorbitol, ethanol, propanol and the like can be optionally used in this invention. Other additives which can be used in this invention are, for example, potassium chloride, ammonium chloride, sodium benzoate, ethylenediamine tetraacetate and the like. Various perfumes can also be incorporated into the liquid detergent composition according to this invention.

This invention now will be further illustrated by, but is by no means limited to, the following Examples.

EXAMPLES 1 THROUGH 9 AND COMPARATIVE EXAMPLES 1 THROUGH 8

Each liquid detergent composition having the composition listed in Table below was prepared by first mixing an aqueous solution of one or more anionic surface active agent with an aqueous solution of semi-polar nonionic surface active agent and, then, the acid listed in Table below was added to the resultant mixture with stirring. Furthermore, coconut fatty acid diethanol amide (2% by weight), ethanol (7% by weight) and water (balance) were added to this mixture with stirring to produce the liquid detergent composition shown in the Table below.

In each composition, a mixture of an aqueous solution (pH=7.0) of sodium alpha-olefin sulfonate (AOS) of 14 carbon atoms and an aqueous solution (pH=7.0) of sodium salt of polyoxyethylene alkylethersulfate (AES) having alkyl groups of 12 to 13 carbon atoms, a linearity of 80% and an average addition mol number of ethylene oxide of 5 was used as the aqueous solution of the anionic surface active agent, and an aqueous solution (pH=7.0) of dimethyldodecylamine oxide was used as the aqueous solution of the semi-polar nonionic surface active agent. The stability of each liquid detergent composition at a low temperature was evaluated by determining the appearance of the liquid and the restoration property of the liquid after freezing according to the test methods set forth below. The results are shown in the Table below.

TABLE

| No. | AOS wt. % | AES wt. % | AAO wt. % | Acid (wt. %) | | pH* | Stability at Low Temperature: Liquid Appearance | Stability at Low Temperature: Restration Property |
|---|---|---|---|---|---|---|---|---|
| Example | | | | | | | | |
| 1 | 3 | 15 | 2 | Toluene sulfonic acid | (0.3) | 7.0 | Good | Good |
| 2 | 6 | 10 | 4 | Toluene sulfonic acid | (0.89) | 6.9 | Good | Good |
| 3 | 10 | 4 | 6 | Benzene sulfonic acid | (1.12) | 6.9 | Good | Good |
| 4 | 10 | 4 | 6 | Toluene sulfonic acid | (1.24) | 7.0 | Good | Good |
| 5 | 10 | 4 | 6 | Xylene sulfonic acid | (1.32) | 7.0 | Good | Good |
| 6 | 10 | 4 | 6 | Cumene sulfonic acid | (1.42) | 7.0 | Good | Good |
| 7 | 12 | 0 | 8 | Toluene sulfonic acid | (1.42) | 7.0 | Good | Good |
| 8 | 20 | 0 | 6 | Toluene sulfonic acid | (1.40) | 7.1 | Good | Good |
| 9 | 10 | 0 | 3 | Toluene sulfonic acid | (0.7) | 6.9 | Good | Good |
| Comparative Example | | | | | | | | |
| 1 | 3 | 15 | 2 | Sulfuric acid | (0.1) | 7.0 | Good | Poor |
| 2 | 6 | 10 | 4 | Sulfuric acid | (0.25) | 7.0 | Good | Poor |
| 3 | 4 | 10 | 6 | Sulfuric acid | (0.35) | 7.0 | Poor | Poor |
| 4 | 10 | 4 | 6 | Cirtic acid | (0.45) | 7.0 | Poor | Poor |
| 5 | 10 | 4 | 6 | Succinic acid | (0.42) | 7.1 | Poor | Poor |
| 6 | 10 | 4 | 6 | Tartaric acid | (0.53) | 7.0 | Poor | Poor |
| 7 | 10 | 4 | 6 | Benzoic acid | (0.87) | 7.0 | Poor | Poor |
| 8 | 12 | 0 | 8 | Sulfuric acid | (0.4) | 6.9 | Poor | Poor |

*pH of the liquid detergent composition at 25° C.

TEST METHOD (1) Appearance of Liquid

A liquid detergent composition sample is placed in a test tube and allowed to stand for one week at 0° C. in a constant temperature bath. After one week, the appearance of the sample is observed with the naked eye. The observation result is represented in the Table as follows.

| | |
|---|---|
| Clear | Good |
| Generation of Turbidity or Precipitate | Poor |

(2) Restoration Property of Liquid after Freezing

A liquid detergent composition sample is placed in a 100 ml glass bottle and allowed to stand for 12 days in a bath, the temperature of which is automatically and repeatedly changed between two states of 15° C. (1 day) and 0° C. (2 days). After 12 days, the appearance of the sample is observed at a temperature of 0° C. with the naked eye. The observation result is represented as follow.

| | |
|---|---|
| Clear | Good |
| Generation of Turbidity, Precipitate or Phase Separation | Poor |

As is clear from the results shown in the Table below, the liquid detergent compositions according to this invention of Examples 1 and 9 had a good stability at low temperature. It was also confirmed that the liquid detergent compositions according to this invention had good detergency.

We claim:

1. A process for producing a liquid detergent composition comprising the steps of:

(a) mixing an aqueous solution of at least one anionic surface active agent selected from the group consisting of the water-soluble salts of alpha-olefin sulfonic acids having 12 to 16 carbon atoms, and the water-soluble salts of polyoxyethylene alkylethersulfates having alkyl groups of 9 to 15 carbon atoms and an average of from 4 to 6 oxyethylene units with an aqueous solution of at least one alkylamine oxide having the formula.

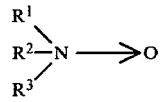

wherein $R^1$ is an alkyl group of 10 to 14 carbon atoms, and $R^2$ and $R^3$ independently an alkyl or hydroxyalkyl group of 1 to 5 carbon atoms (b) adding, to the mixture, at least one arylsulfonic acid selected from the group consisting of benzene sulfonic acid, toluene sulfonic acid, xylene sulfonic acid and cumene sulfonic acid in an amount of from 0.2 to 3.0% by weight, based on the total weight of the liquid composition containing from 6 to 25% by weight of said anionic surface active agent and from 2 to 8% by weight of said alkyl amine oxide.

2. A process as claimed in claim 1, wherein said water-soluble salts are alkali metal salts, alkaline earth metal salts, ammonium salts and alkanol amine salts.

* * * * *